US011542637B2

(12) United States Patent
Steel et al.

(10) Patent No.: US 11,542,637 B2
(45) Date of Patent: Jan. 3, 2023

(54) ZONED FABRIC SYSTEMS AND METHODS

(71) Applicant: REEBOK INTERNATIONAL LIMITED, London (GB)

(72) Inventors: David Steel, Boston, MA (US); Patrick O'Sullivan, Cambridge, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 0 days.

(21) Appl. No.: 16/687,032

(22) Filed: Nov. 18, 2019

(65) Prior Publication Data

US 2020/0087822 A1 Mar. 19, 2020

Related U.S. Application Data

(62) Division of application No. 15/198,750, filed on Jun. 30, 2016, now Pat. No. 10,480,105.

(51) Int. Cl.

| | |
|---|---|
| ***D03D 1/00*** | (2006.01) |
| ***A41D 31/02*** | (2019.01) |
| ***D03D 13/00*** | (2006.01) |
| ***D03D 11/02*** | (2006.01) |

(52) U.S. Cl.

CPC ..... *D03D 1/0035* (2013.01); *A41D 31/02* (2013.01); *D03D 11/02* (2013.01); *D03D 13/004* (2013.01); *A41D 2500/20* (2013.01); *D10B 2501/04* (2013.01); *D10B 2501/042* (2013.01)

(58) Field of Classification Search

None

See application file for complete search history.

(56) References Cited

U.S. PATENT DOCUMENTS

2013/0086726 A1* 4/2013 Patercsak ..... D03D 11/02 2/69

2017/0172240 A1* 6/2017 Massey ..... A41D 31/185

* cited by examiner

*Primary Examiner* — Shawn Mckinnon

(74) *Attorney, Agent, or Firm* — Sterne, Kessler, Goldstein & Fox P.L.L.C.

(57) ABSTRACT

A garment may include a first woven component, a second woven component, a space between the first and second woven components defining a channel filled with a fill material, and a third woven component extending such that the first and second woven components are woven together where there is no channel. The channel may be filled with a filler material. Multiple channels may be provided such that they form a zoned pattern in the garment.

5 Claims, 6 Drawing Sheets

ZONED FABRIC SYSTEMS AND METHODS

CROSS REFERENCE TO RELATED APPLICATIONS

This application is a divisional of U.S. application Ser. No. 15/198,750, filed Jun. 30, 2016 and now pending, the disclosure of which is incorporated by reference in their entirety.

FIELD

Embodiments of the present invention generally relate to a zoned fabric. More particularly, embodiments of the present invention relate to garments that include seamless zoned channels for filling with material (e.g., down, synthetic down, ball fiber, synthetic insulators, etc.).

BACKGROUND

"Zoned" fabric systems used in garments afford a benefit of targeted insulation, or padding, for example. This allows portions of an individual wearing the garment to be particularly targeted for warming, or padding.

BRIEF SUMMARY OF THE INVENTION

Difficulties arise in the appearance of zoned fabric systems, which may have defined seams or other closure mechanisms that risk failure. Additionally, zoned fabrics typically utilize complicated construction techniques in the construction of garments, for example by cutting and sewing many fabrics together to achieve the aesthetic and function, leading to increased production and manufacturing time and decreased efficiency. A need for an improved zoned fabric system is identified.

Advantageously, embodiments of the present invention may include seamless woven down fill channels. This is an improvement on systems that require sewing, bonding, or other construction to create down fill channels. Moreover, in some embodiments, these systems advantageously create a single layer of woven fabric where the zoned fill channels are not required (e.g., when laying out a garment pattern to be cut from the fabric).

Embodiments of the present invention relate to a zoned garment, including a first woven component, a second woven component, a space between the first and second woven components defining a channel filled with a fill material, and a third woven component extending such that the first and second woven components are woven together where there is no channel.

In some embodiments, the garment includes a plurality of channels filled with a fill material such that the channels form a pattern in the garment. In some embodiments, the channel is a seamless channel. In some embodiments, the fill material is an insulative material. In some embodiments, the fill material is padding material. In some embodiments, the garment is an upper body garment. In some embodiments, the garment is a headwear garment.

Embodiments of the present invention also relate to a zoned fabric, including a first woven component formed substantially parallel to a shuttle direction of a loom, a second woven component formed substantially parallel to a shuttle direction of a loom, a space between the first and second woven components defining a channel extending generally parallel to a shuttle direction of a loom and extending along a plane of the fabric, the channel configured to be filled with a fill material, and a third woven component extending such that the first and second woven components are woven together at edges of the channel.

In some embodiments, the fabric includes a plurality of channels filled with a fill material such that the channels form a pattern in the garment. In some embodiments, the channel is a seamless channel. In some embodiments, the fill material is an insulative material. In some embodiments, the fill material is padding material.

Embodiments of the present invention also relate to a method of making a zoned fabric, including weaving a first fabric component extending substantially parallel to a shuttle direction of a loom, weaving a second fabric component extending substantially parallel to a shuttle direction of a loom and spaced from the first fabric component and defining a channel extending generally parallel to a shuttle direction of a loom and extending along a plane of the fabric, weaving a third woven component extending such that the first and second woven components are woven together at edges of the channel.

In some embodiments, the method also includes cutting a garment component from the fabric; and filling the channel with a filler material. In some embodiments, the fabric includes a plurality of channels filled with a fill material such that the channels form a pattern in a finished garment.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE DRAWINGS/FIGURES

The accompanying figures, which are incorporated herein, form part of the specification and illustrate embodiments of the present invention. Together with the description, the figures further serve to explain the principles of and to enable a person skilled in the relevant arts to make and use the invention.

DETAILED DESCRIPTION OF THE INVENTION

The present invention will now be described in detail with reference to embodiments thereof as illustrated in the accompanying drawings. References to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

Figure 1:
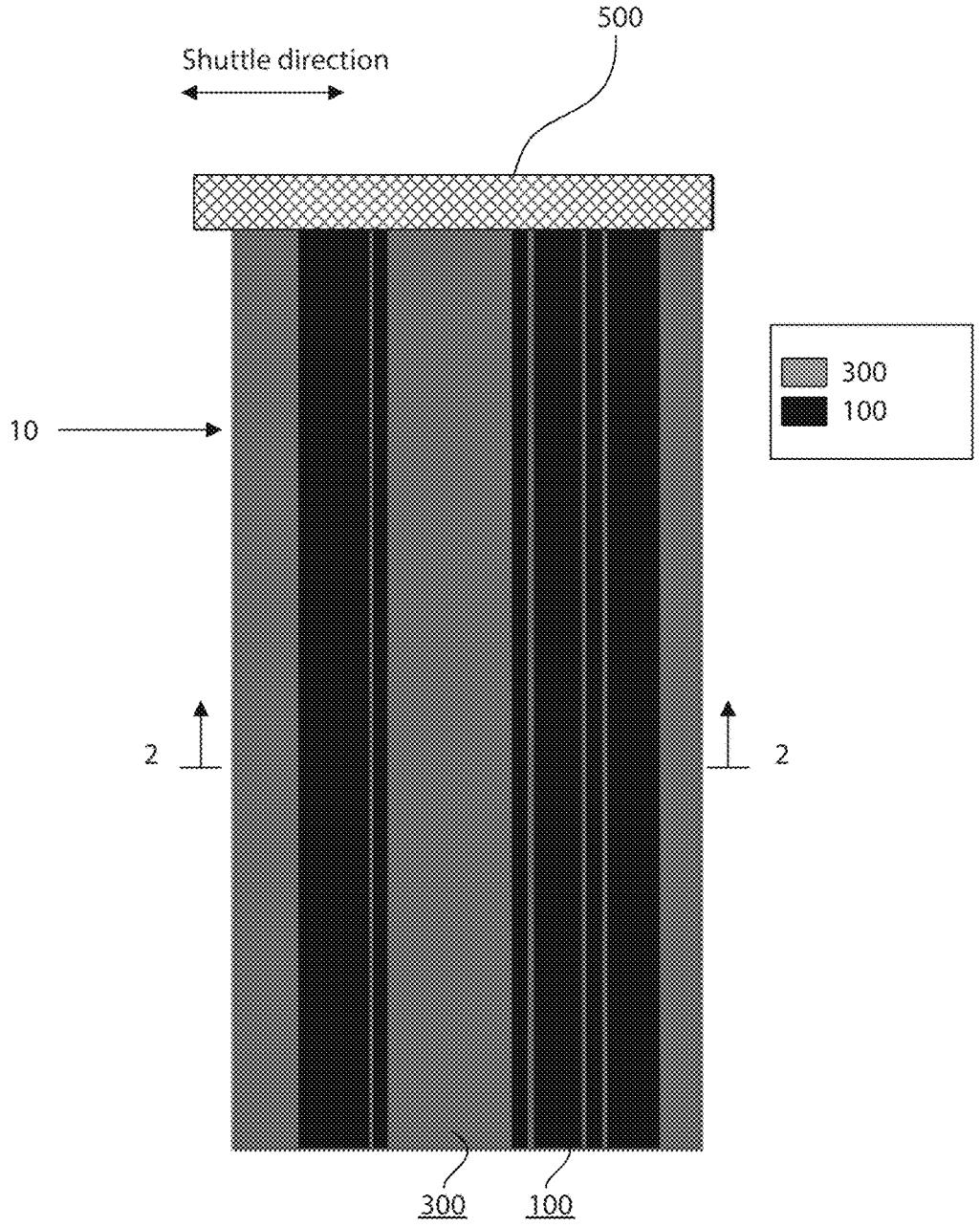
FIG. 1 is a schematic illustration of a woven fabric being made according to an embodiment of the present invention.
Figure 2:
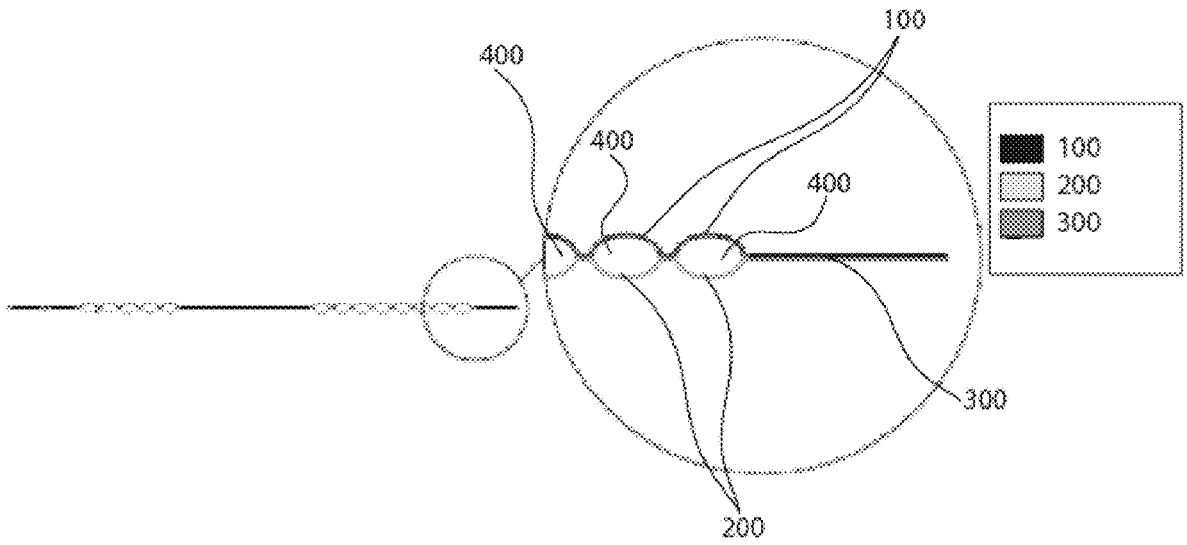
FIG. 2 is a schematic cross-sectional view of the woven fabric shown in FIG. 1, taken along line 2-2 according to an embodiment.

As shown in FIGS. 1 and 2, a zoned fabric 10 may be made with loom 500. In some embodiments, loom 500 is configured to weave zoned fabric 10 including a first woven component 100 and second woven component 200 (as shown in FIG. 2, for example). In some embodiments, first and second woven components 100/200 are spaced from one another, forming a space or "channel" 400. Channel 400 may be filled with a filler material (e.g., synthetic down, down, ball fiber, polyester based fiber fills, or other synthetic insulators). In some embodiments, when there is no channel 400 along a distance of the fabric 10, the first and second woven components 100/200 are woven together, forming a single third woven component 300. As such, the resulting fabric 10 in a finished state include channels 400 and third woven component 300, where the channels 400 are formed seamlessly as a result of the weaving of first and second woven components 100/200.

For clarity in the figures, each of the components 100, 200, and 300 are shown in a different shade, denoting their position along fabric 10. A key is provided in the figures.

In some embodiments, channels 400 may be disposed at equal intervals along fabric 10. In some embodiments, channels 400 may be disposed at varying intervals along fabric 10. In some embodiments, channels 400 may be of equal lengths, or may vary in lengths. In some embodiments, channel 400 may be substantially linear along fabric 10. In some embodiments, channel 400 may be generally nonlinear along fabric 10. In some embodiments, channels 400 may intersect one another at points along fabric 10. In some embodiments, channels 400 may form a complex shape along fabric 10. In some embodiments, channels 400 may be of the same width, or of varying widths along fabric 10. In some embodiments, the complex shapes of channels 400 may advantageously provide an aesthetic appeal to a finished garment made from fabric 10. Channels 400 may be filled with a filler material (e.g., down, synthetic down, ball fiber, polyester based fiber, other synthetic insulators, etc.). In some embodiments, different channels 400 may be filled with a different amount, density, or type of filler material. In some embodiments, individual channels 400 may be filled with a varying amount, density, or type of filler material along the channel or zone. In this regard, separate zones of fabric 10 may be warmer or more insulated in one zone, and include less insulation in other zones.

These channels are seamless, rather than requiring sewing, bonding, or other construction to create channels (e.g., down fill channels, padding fill channels, or the like). Moreover, in some embodiments, these systems advantageously create a single layer of woven fabric where the zoned fill channels 400 are not required (e.g., when laying out a garment pattern to be cut from the fabric).

As shown in FIGS. 1 and 2, for example, zoned fabric 10, may include a first woven component 100 formed substantially parallel to a shuttle direction of loom 500, a second woven component 200 formed substantially parallel to a shuttle direction of loom 500, a space between the first and second woven components 100/200 defining a channel 500 extending generally parallel to a shuttle direction of loom 500 and extending along a plane of the fabric 10, the channel 400 configured to be filled with a fill material, and a third woven component 300 extending such that the first and second woven components are woven together at edges of the channel 400. In this regard, as fabric 10 is created and extends from loom 500, the channels 400 may be created to extend generally perpendicularly (or substantially non-parallel) to the shuttle direction of loom 500.

As shown in FIG. 1, channels 400 may extend along a length of fabric 10. In this regard, the point at which fabric components 100 and 200 are woven together is along a shuttle direction of loom 500. As fabric 10 is created and extends from loom 500, the shuttle pattern may create fabric component 300 as a single integrated woven component. This advantageously leads to a seamless effect at the edges of channels 400, as shown in FIG. 2, for example. This is in contrast to a typical sewn or bonded seam which is formed with an additional component, e.g., a thread creating a seam. Here, fabric layers may be woven together to create one fabric from two layers, rather than bonding/stitching two layers together. In some embodiments, fabric 10 may include a plurality of third woven components 300, which may extend varying distances along fabric 10, both along a direction generally parallel to a shuttle direction of loom 500 as well as other directions along fabric 10. In some embodiments, third woven components 300 may extend at a uniform length along fabric 10.

Figure 5:
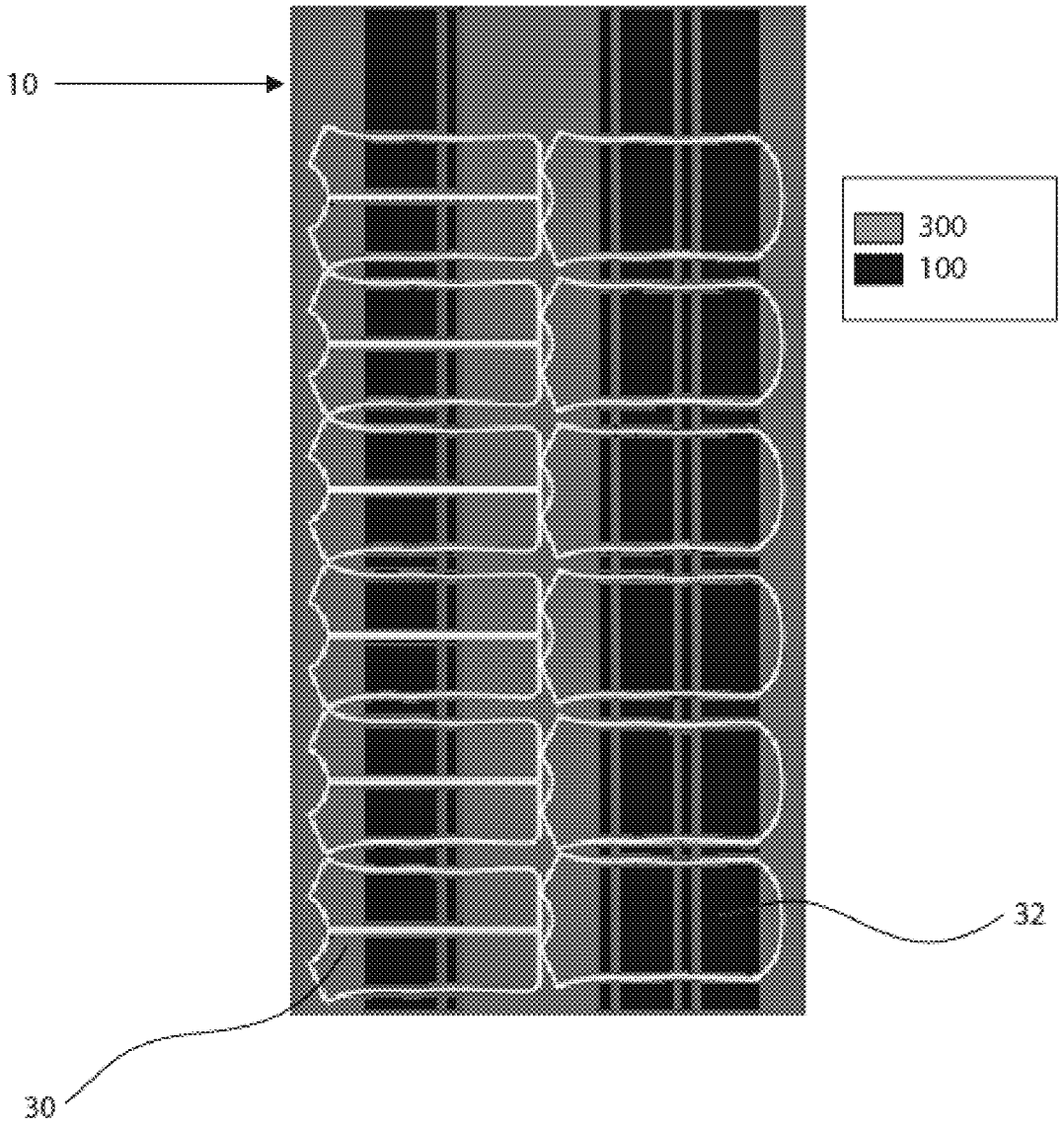
FIG. 5 is a schematic illustration of how garment pieces may be formed from the woven fabric shown in FIG. 1 according to an embodiment.

As shown in FIG. 5, fabric 10 may be used to form a first garment component 30 and second garment component 32 to form a full garment, such as, for example, a jacket or vest. The garment may comprise an upper body garment, or a lower body garment. It is contemplated that the finished garment may include any suitable garment having a waist portion, including, but not limited to, shorts, board shorts, pants, shirts, jackets, dresses, athletic garments, dress garments, headwear such as hats or helmets, and other suitable apparel. As shown in FIG. 5, channels 400 may form patterns in fabric 10, utilizing the pattern of fabric portion 300 and channels 400 to provide a single sheet of fabric 10, from which multiple garment portions 30/32 may be cut from. In some embodiments, the patterns formed by channels 400 in fabric 10 may be symmetrical, such that multiple first garment components 30 may be formed in fabric 10, for example. In some embodiments, first garment component 30 may include channels 400, while second garment component 32 does not include channels 400. In some embodiments, channels 400 may be of the same width. In some embodiments, channels 400 may be of varying widths. Advantageously, these zoned fabric systems used in garments afford a benefit of targeted insulation, or padding, for example, while maintaining efficiency in construction and increasing seamless aesthetic appeal. These systems allow portions of an individual wearing the garment to be particularly targeted for warming, or padding, In some embodiments, the garment components include a plurality of channels 400 filled with a fill material such that the channels 400 form a pattern in the garment (see, for example, FIGS. 5 and 6). In some embodiments, the fill material is an insulative material. In some embodiments, the fill material is padding material. In some embodiments, the garment is an upper body garment. In some embodiments, the garment is a lower body garment. In some embodiments, the garment is a headwear garment.

Figure 3:
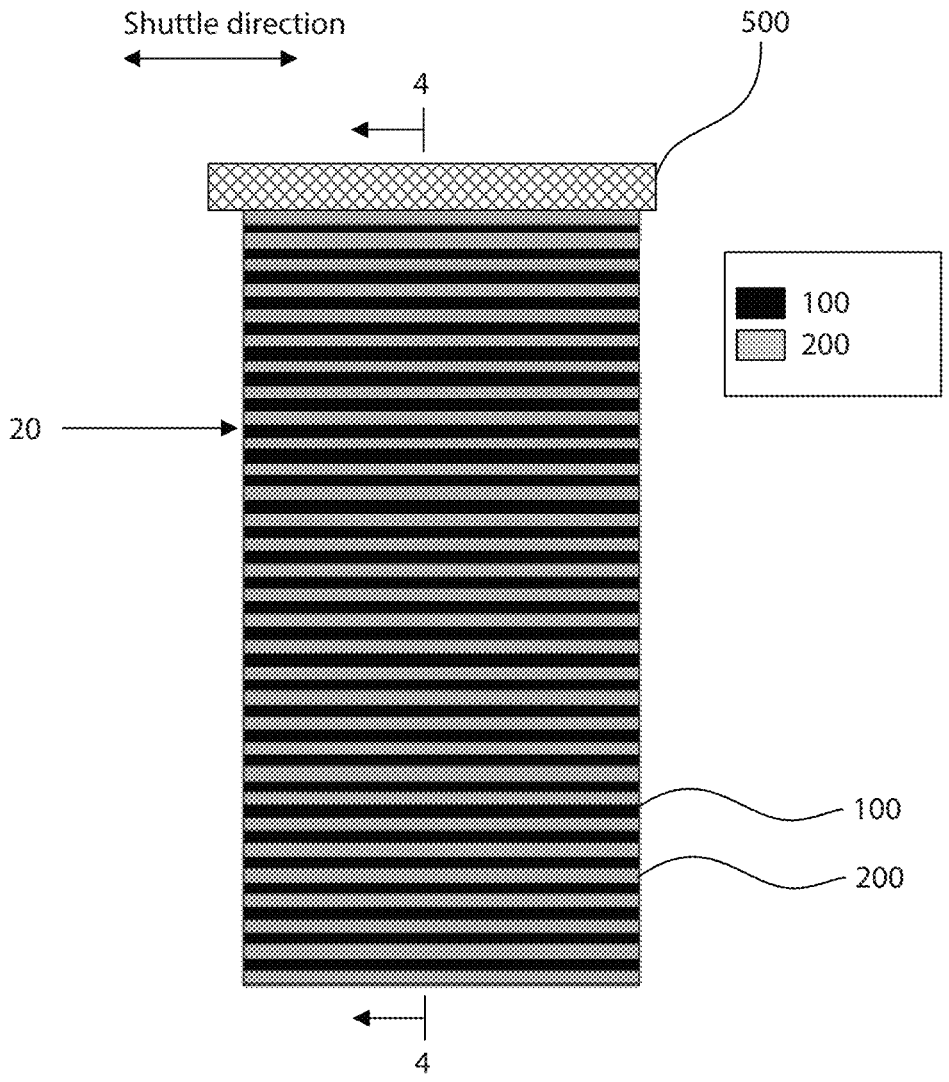
FIG. 3 is a schematic illustration of a woven fabric being made according to the prior art.
Figure 4:
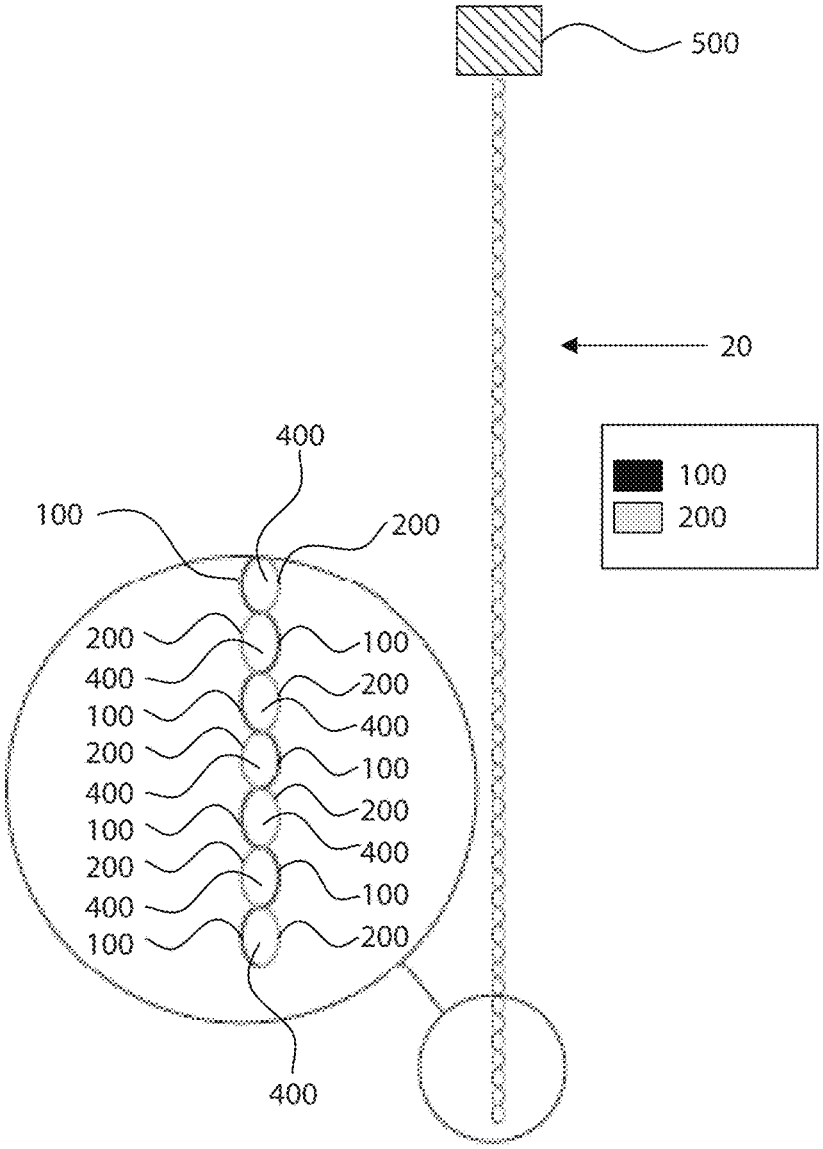
FIG. 4 is a schematic cross-sectional view of the woven fabric shown in FIG. 3, taken along line 4-4 according to an embodiment.

Turning to FIGS. 3 and 4, in some embodiments, a zoned fabric 20 may include first and second fabric components 100 and 200, but no third woven component 300 is provided. In some embodiments, first and second woven components 100 and 200 are woven together at a substantially linear edge, resulting in a channel 400 substantially along a shuttle direction of loom 500.

Figure 6:
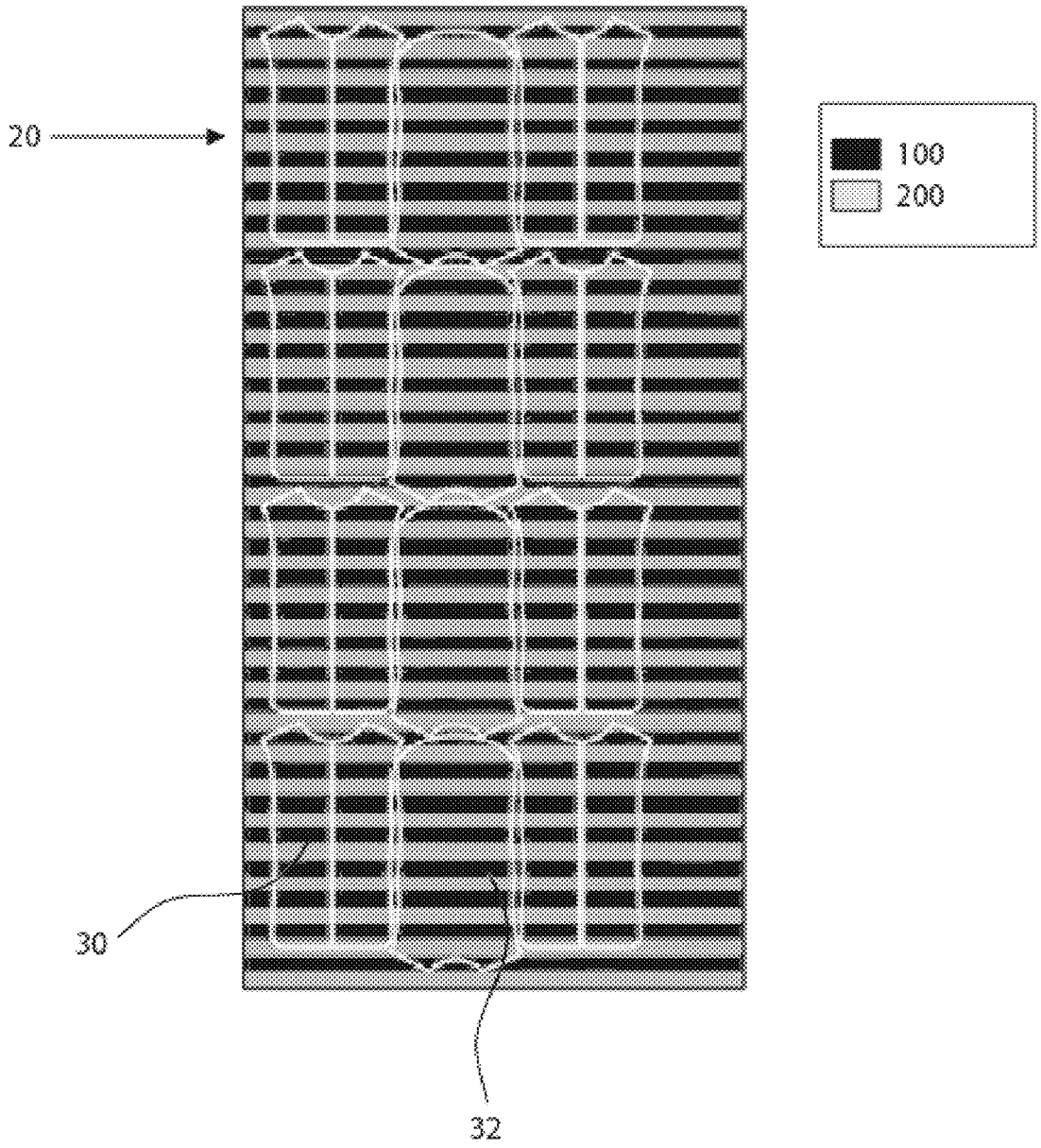
FIG. 6 is a schematic illustration of how garment pieces may be formed from the woven fabric shown in FIG. 3 according to an embodiment.

As shown in FIG. 6, zoned fabric 20 similarly may provide material for garment portions 30/32 to be cut from. In this regard, multiple channels 400 may be formed extending substantially along a shuttle direction of loom 500. In some embodiments, multiple channels 400 may be formed back-to-back such that there is no third fabric portion 300 extending between the channels 400. In some embodiments, channels 400 may be of the same width, or may be of varying widths.

In embodiments, the garment portions may be the same continuous fabric material, or alternatively may be separate fabric material that are attached by suitable means, including, but not limited to, stitching, adhesive, and combinations thereof.

Embodiments of the present invention also relate to a method of making a zoned fabric, including weaving a first fabric component extending substantially parallel to a shuttle direction of a loom, weaving a second fabric component extending substantially parallel to a shuttle direction of a loom and spaced from the first fabric component and defining a channel extending generally parallel to a shuttle direction of a loom and extending along a plane of the fabric, weaving a third woven component extending such that the first and second woven components are woven together at edges of the channel.

In some embodiments, the method also includes cutting a garment component from the fabric, and filling the channel with a filler material. In some embodiments, the fabric includes a plurality of channels filled with a fill material such that the channels form a pattern in a finished garment. In some embodiments, the channels may be filled while the fabric is being woven on the loom, or may be filled in a secondary operation after the components have been cut from the fabric.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A method of making a zoned fabric, comprising:

weaving a first fabric component extending substantially parallel to a shuttle direction of a loom;

weaving a second fabric component extending substantially parallel to the shuttle direction of the loom and spaced from the first fabric component and defining a plurality of channels extending generally parallel to the shuttle direction of the loom and extending along a plane of the fabric;

weaving a third woven component extending such that the first and second woven components are woven together at edges of each of the plurality of channels;

wherein the plurality of channels include a first channel defining a first space between the first and second woven compartments and a second channel defining a second space between the first and second woven compartments, wherein along the first channel, the first woven component is disposed above the second woven component, and wherein along the second channel, the first woven component is disposed below the second woven compartment;

cutting a garment component from the zoned fabric; and filling the plurality of channels with a filler material.

2. The method of claim 1 further comprising:

filling the plurality of channels with a fill material such that the channels form a pattern in a finished garment.

3. The method of claim 1, wherein the plurality of channels are each a seamless channel.

4. The method of claim 2, wherein fill material is an insulative material.

5. The method of claim 2, wherein the fill material is padding material.

* * * * *